United States Patent [19]

Daukas

[11] Patent Number: 4,549,707

[45] Date of Patent: Oct. 29, 1985

[54] TORQUE OPTIMIZING NEUTRAL INERTIA DEVICE

[75] Inventor: Anthony Daukas, Laguna Beach, Calif.

[73] Assignee: General Dynamics Pomona Division, Pomona, Calif.

[21] Appl. No.: 453,842

[22] Filed: Dec. 27, 1982

[51] Int. Cl.[4] ..... F42B 15/02

[52] U.S. Cl. ..... 244/3.21; 244/3.1

[58] Field of Search ..... 73/535, 536; 244/3.1, 244/3.2, 3.21, 3.15

[56] References Cited

U.S. PATENT DOCUMENTS

| | | | |
|---|---|---|---|
| 2,431,706 | 12/1947 | Nisbet et al. | 244/76 |
| 2,643,871 | 6/1953 | Warrick | 73/540 |
| 2,649,292 | 8/1953 | Dessert et al. | 73/535 |
| 2,698,215 | 12/1954 | Peck | 73/535 |
| 2,715,528 | 8/1955 | Schulte | 73/540 |
| 2,829,507 | 4/1958 | Knudson | 73/535 |
| 3,365,148 | 1/1968 | Preston et al. | 244/3.18 |
| 3,365,942 | 1/1968 | Blazek et al. | 244/3.1 |
| 3,937,144 | 2/1976 | Daniels | 244/3.1 |
| 3,955,165 | 5/1976 | Stubbs et al. | 73/540 |
| 4,029,270 | 6/1977 | Niemeier | 244/3.21 |
| 4,037,806 | 7/1977 | Hirsch et al. | 244/3.21 |
| 4,054,254 | 10/1977 | Cole | 244/3.21 |
| 4,116,404 | 9/1978 | Howell | 244/3.1 |
| 4,431,150 | 2/1984 | Epperson, Jr. | 244/3.1 |

*Primary Examiner*—Richard E. Schafer
*Assistant Examiner*—D. K. Cornwell
*Attorney, Agent, or Firm*—Neil F. Martin; Edward B. Johnson

[57] ABSTRACT

A control system for rolling airframes utilizing variable pitch control surfaces includes a variable inertia device within the control system connected to the servo control motors that control the control surfaces, with the variable inertia device selectively controllable to optimize the inertia of the control system for optimizing the power requirements of the control system. The variable inertia means includes a rotatable mass with means for moving the effective position of the mass radially inwardly and outwardly from the rotary shaft of the control system for selectively varying the inertia of the control system.

18 Claims, 8 Drawing Figures

TORQUE OPTIMIZING NEUTRAL INERTIA DEVICE

BACKGROUND OF THE INVENTION

The present invention relates to control systems and pertains particularly to means for optimizing the power requirements of a control system.

Space and weight considerations are at a premium aboard aircraft. This is particularly so for missiles and the like wherein it is desirable to minimize the size and power requirements of the control system components in order to maximize the payload of the airframe.

Considerable effort has gone into the optimization of power requirements for control systems of various airframes including rolling airframe missles. Most of such efforts however have focused upon such design parameters as wing hinge line, control gear ratios, and servo motor armature resistance and other similar parameters.

The present invention is based on the concept of utilizing the roll resonance phenomenon unique to rolling airframes to minimize torque requirements and thereby reduce power within the control system.

SUMMARY AND OBJECTS OF THE INVENTION

It is the primary object of the present invention to provide an improved airframe control system.

In accordance with the primary aspect of the present invention, a control system for a rolling airframe utilizes a variable inertia within the control system for using the aerodynamic forces acting on the wings to position the wings and transfer the reaction torque to the airframe through the use of reflected inertia thereby reducing the steering torque required by the servo motors.

BRIEF DESCRIPTION OF THE DRAWINGS

The above and other objects and advantages of the present invention will become apparent from the following description when read in conjunction with the accompanying drawings wherein.

DETAILED DESCRIPTION OF A PREFERRED EMBODIMENT

Figure 1:
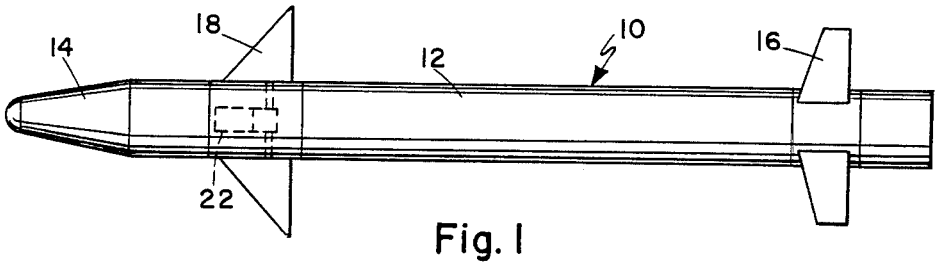
FIG. 1 illustrates a typical missile showing the position of the torque optimizing device.

Referring to the drawings, as illustrated in FIG. 1, is a missile designated generally by the numeral 10 of the rolling airframe type having an elongated generally cylindrical body 12 with a nose section 14. A plurality of stabilizing tails (or fins) 16 are secured to and extend radially outward from the body near the back end of the missile body. A plurality of steering wings or fins 18 extend radially outward from the body of the missile near the forward end thereof. These steerable wings or fins 18 are controlled by a servo motor which in turn is controlled by the control system of the missile to steer it on its course.

The present invention comprises a torque optimizing neutral inertial device which is coupled to the servo motor of the control system for optimizing the inertia of the control system to minimize torque requirement and power requirements of the control system. This invention utilizes the roll resonance phenomenon of the rolling airframe in conjunction with the aerodynamic forces acting on the wings to position the wings and transfer reaction torque to the airframe through use of reflected inertia, to thereby considerably reduce the steering torque required by the servo motor.

Figure 2:
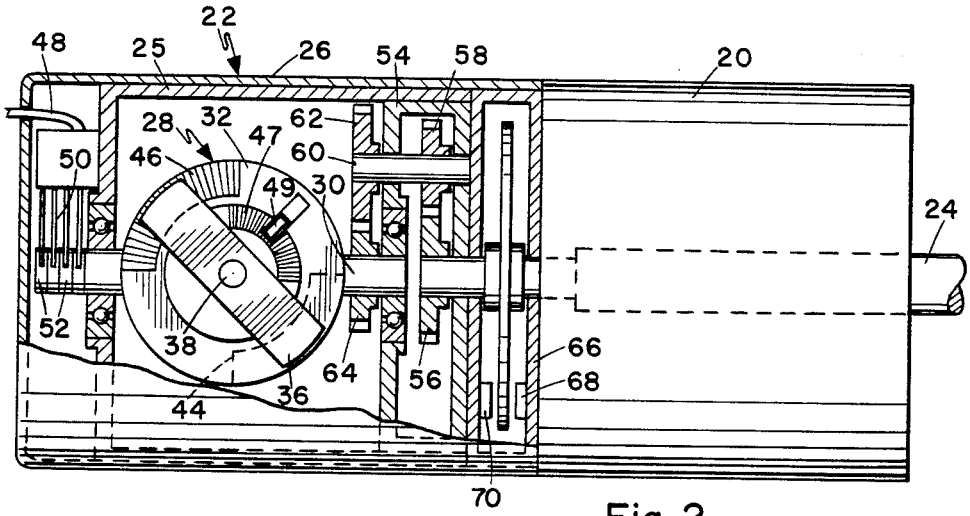
FIG. 2 is a side elevation view of the torque optimizing unit, with portions cut away.
Figure 3:
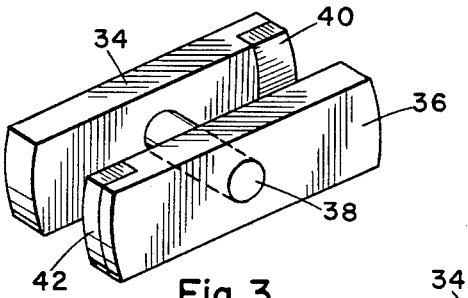
FIG. 3 is a perspective view of the rotor.
Figure 4:
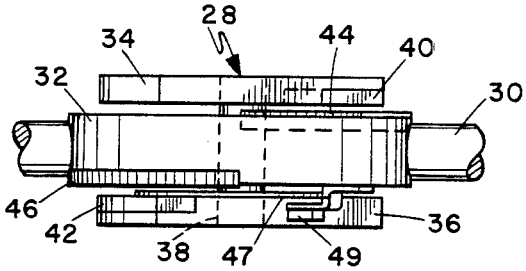
FIG. 4 is a top plan view of the rotor and mounting assembly.

In accordance with the present invention, a servo motor 20 as illustrated in FIG. 2 includes a torque optimizing device 22 coupled to the drive shaft of the servo motor. The servo motor includes a drive shaft 24 coupled on one end to control the wings of the airframe and coupled at the opposite end to the torque optimizing device. In the illustrated embodiment, the torque optimizing device includes a generally cylindrical housing 25 mounted within a common cover 26 with the servo motor. The torque optimizer includes a variable inertia rotor designated generally by the numeral 28 and including a shaft 30 rotatably mounted within suitable support bearings within the housing.

Figure 5:
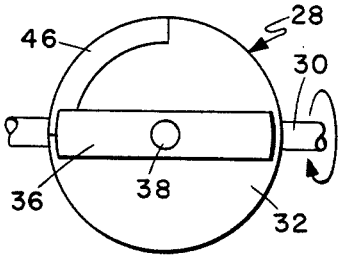
FIG. 5 is a side elevation view of the rotor assembly showing the minimum inertia position.
Figure 6:
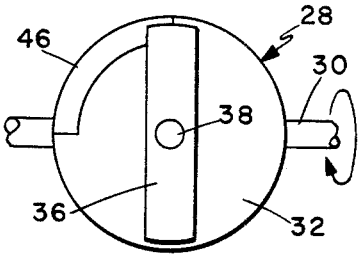
FIG. 6 is a similar side elevation view showing the maximum inertia position.

The rotor includes a generally circular central disk member 32 mounted on the shaft 30 and having an axis extending at right angles to the axis of shaft 30. The disc 32 serves as support means for rotatably mounting a pair of inertial arms 34 and 36 on a rotatable shaft 38. The inertial arms 34 and 36 serve as the inertial mass of the system, and each include fixed magnets 40 and 42 at outer ends thereof, which cooperate with electromagnetic coils or windings 44 and 46 on the disk 32 for controlling the positioning of the arms 34 and 36. The two rotor arms 34 and 36 are preferably of a high density material such as tungsten or the like and as illustrated, are mounted on an axis intersecting the axis of the rotor shaft 30 at right angles thereto. These arms selectively vary in position during operation from a minimum inertia position extending parallel to the shaft 30 as illustrated in FIG. 5 to a maximum inertia position extending at right angles to the axis of the shaft 30 as illustrated in FIG. 6.

Control signals for controlling the positioning of the rotor arms are communicated to the rotor by means of electrical leads 48 connected by a slip ring assembly including contact fingers 50 engaging slip rings 52 on the shaft 30. The requirements of multiple rotation of the rotor in this embodiment necessitates the use of the slip ring-type of assembly.

The actual angular positioning of the arms 34 and 36 is determined by means of an encoder disc 47 mounted on and rotatable with shaft 38 and a sensing unit 49 mounted on the support disc 32. This provides feedback to the control system for positioning of the arms 34 and 36.

In order to achieve the maximum inertial effect in the minimum amount of space (optimum inertial effect), a gear assembly drivingly connects the servo motor 20 to the inertial device. This gear assembly includes a housing 54 mounted within the housing 25 and supporting one end of the drive shaft 24 of the servo motor. A pinion gear 56 is mounted on the shaft 24 drivingly engaging a smaller pinion gear 58 mounted on a shaft 60, on which is mounted a gear 62 which in turn drives a smaller central pinion gear 64 mounted on the rotor shaft 30. This provides an overdrive arrangement driving the rotor at stepped-up revolutions with respect to the output of the servo motor and magnifies the inertial feedback to the servo motor 20. This magnifies the inertial feedback and reaction to the control surfaces.

An incremental encoder including a disk 66 mounted on the servo motor shaft and sensing units 68 and 70 supplies position and rate feedback for the wing servo as well as motor communication signals.

Figure 7:
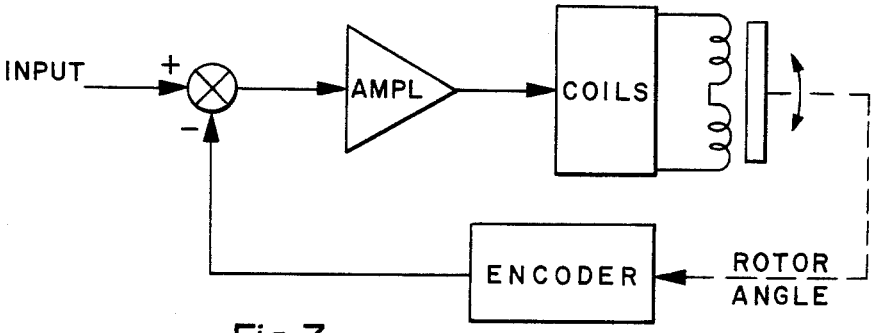
FIG. 7 is a block diagram of the servo loop.

Referring to FIG. 7, a schematic diagram of the servo loop is illustrated. In operation an input signal is combined with the feedback signal with the differential amplified and fed to the coil windings for positioning of the rotor arms for optimum inertia reaction. The input command is sinusoidal at missile roll rate and has a peak amplitude of zero degrees to ninety degrees proportional to the ratio of the peak aerodynamic torque acting on the wings to the peak wing deflection. This arrangement permits the use of a much smaller lower torque servo motor than would otherwise be possible. A mathematical analysis of the parameters of this system is as follows:

The motor torque required for control of a canard-configured rolling airframe missile is shown by the following formula:

$$Tm(t) = \frac{\omega Jw\zeta p\ \delta(t)}{Nz} + \frac{Jw\zeta p}{Nz}(W_1^2 - W^2)\mathrm{Sin}\omega t \quad (1)$$

where:

$T_m$=motor torque $\omega$=frequency of rolling airframe $J_w$=reflected inertia of the wing/gear/motor system p=peak amplitude of wing deflection (command)

$\omega$l=natural frequency of the aerodynamically loaded wing/gear/motor spring-mass system N=gear reduction ratio Z=gear efficiency The first term on the right of equation (1) represents the initial impulse or instantaneous torque required for the wings to reach steady state. The second term represents the sinusoidal torque required of the motor to maintain steady state.

In order to optimize the torque motor size and to reduce the motor current as well as ultimate power consumption, it is desirable to minimize the integral of the steady state term of equation (1).

Considering the steady state term only, it is obvious that the torque required is zero when:

$$\omega_1^2 = \omega^2 \quad (2)$$

The idea is to force the frequency or "$\omega$-match" in (2) to happen. The present invention provides a feasible system to implement this concept.

From the above analysis:

$$\omega_1^2 = \frac{KA}{Jw} \quad (3)$$

where $K_A$ is defined as the aerodynamic spring constant of the wing servo, and $$K_A = \frac{T_A}{\zeta p} = \frac{\text{peak aerodynamic torque acting on wings}}{\text{peak wing deflection}} \quad (4)$$

also $$J_w = N^2 I_p + I_w \quad (5)$$

where $I_p$=motor armature/gear pinion inertia $I_w$=wing/sector gear inertia

Consider the term:

$$\omega_1^2 = \frac{KA}{N^2 Ip + Iw} \quad (6)$$

$K_A$ is highly variable during flight, therefore the "normally" constant N, $I_p$, or $I_w$ values must change in order to vary $\omega_1$, in an effort to match it to $\omega$. Of these three quantities, it appears that a method of varying Ip would produce the desired results and is the method implemented by the present invention.

Using typical flight and hardware parameters for one example of a rolling airframe, Maximum $K_A$ can vary under worst case fixed-flight conditions as shown in FIG. 1 over a 20 second flight time.

Using a maximum absolute value of $K_A$=1432 and solving for the change in $I_p$ necessary to match $\omega_1$,=$\omega$=10 Hz (nominal) for the particular example:

$$I_p = \frac{K_A}{N^2 W_1^2} - \frac{Iw}{N^2} \quad (7)$$

$$I_p = \frac{1432}{(16)^2 (62.83)^2} - \frac{(.0063)}{(16)^2}$$

$$I_p = 1.392\ E\text{-}3\ \text{IN-LB-SEC}^2$$

Since the nominal value of $I_p$ used is 3.5E-4 IN-LB-SEC$^2$ for example, the value of $I_p$ must change (increase) by a factor of 3.98× to provide the $\omega$-match.

Assuming that the optimizer has an inertia equal to $I_p$, the tungsten rotor must have seven (7) times its inertia at ninety degrees than it has at the zero degree position to effect a total $I_p$ change of four (4) times. The inertia arms of the rotor assembly would pivot on a low inertia design central shaft and support disk that is drivingly connected by a two stage gear box to the servo motor shaft pinion and geared up by a 5:1 ratio. Using tungsten rotor halves, the arms would be approximately 0.14 of an inch thick by 0.28 of an inch wide and approximately 1.0 inches long for a servo motor with a pinion inertia (IP) on the order of 7.1E-4 OZ-1N-SEC$^2$. This type of assembly is similar to a section of a limited angle torque motor and significant mechanical advantage is obtained by maximizing the magnetic lever arm thus reducing the power required. This arrangement reduces the size and power of the servo motor required and makes a very compact arrangement.

Figure 8:
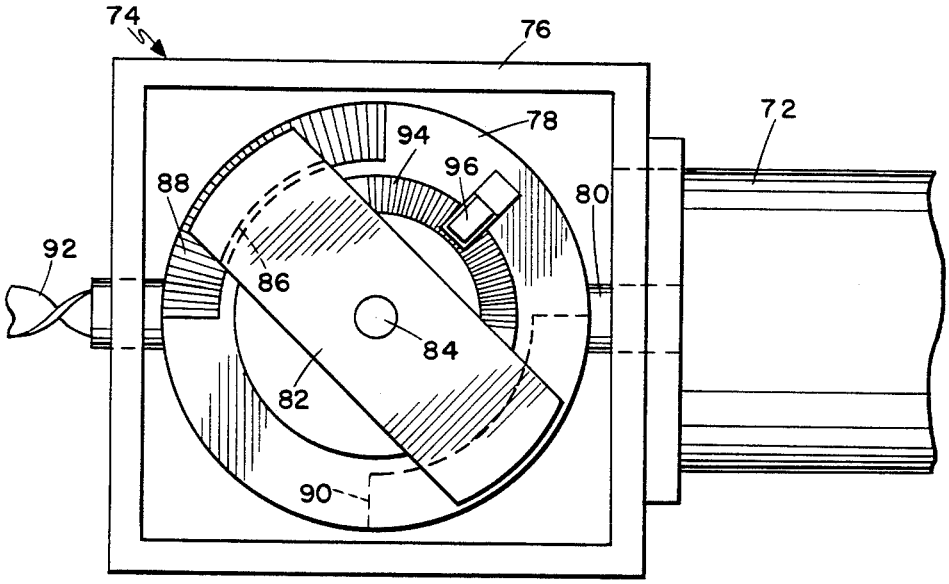
FIG. 8 is a side elevation view of an alternative direct driven rotor assembly.

Turning to FIG. 8, an alternate embodiment of the invention is illustrated wherein a servo motor having an inertial device 74 coupled thereto, which includes a housing 76 in which is mounted a rotor including a support disk 78 directly coupled to the motor drive shaft 80 for a one to one direct coupling. The rotor includes a pair of variable position arms, only one of which 82 is shown, mounted on a support shaft 84 which is mounted for rotation about an axis intersecting at ninety degrees to the axis of the servo motor shaft 80. The inertial arms each include magnets only one of which is shown at 86 which react with electromagnetic coils 88 and 90 on the disk 78 for positioning the inertial arms. Since the rotor is directly coupled to the shaft of the servo motor 72 and rotates no more than that of the servo motor, which would be a maximum of one hundred and eighty degrees (180°), electrical coupling to electromagnetic controls may be achieved by means of a twist cable 92 which can accommodate the alternating motion of the inertial unit.

Means for sensing the position and movement of the arm 86 includes an encoder disc 94 mounted on the shaft 84 and a sensing unit 96 mounted on the support disc 78. This provides feedback to the control system for positioning the inertia arm 82, and its associated arm, not shown.

While I have illustrated and described my invention by means of specific embodiments, it is to be understood that numerous changes and modifications may be made therein without departing from the spirit and scope of the invention as defined in the appended claims.

I claim:

1. Air frame control system including:

a variable pitch control surface, first control means comprising a rotary servo motor for controlling the pitch of said control surface, and second control means comprising a variable inertia rotor for controlling the inertial reaction of said control surface.

2. The control system of claim 1 wherein said rotor comprises:

a rotary shaft, and a pair of arms pivotally mounted on said shaft for pivotal movement between a position extending parallel to said shaft for minimum inertia of said rotor and a position extending at a right angle to said shaft for maximum inertia of said rotor.

3. The control system of claim 2 wherein said rotor includes:

a circular disk mounted on said rotary shaft substantially in the plane of the axis thereof with the axis of said disk extending at substantially a right angle to the axis of said rotary shaft.

4. The control system of claim 3 wherein said pair of arms are mounted for rotation about the axis of said disks, each of said arms includes a magnet mounted on one end thereof, and said disk includes electromagnetic means disposed along selected sectors thereof for cooperating with said magnets for controlling the position of said arms.

5. The control system of claim 2 wherein said rotary shaft is directly coupled to the shaft of said servo motor.

6. The control system of claim 2 wherein said rotor is drivingly connected to said servo motor by means of a gear box for driving the rotor at a angular velocity different from said servo motor.

7. The control system of claim 6 wherein said gear box has a stepped up gear ratio to said rotor.

8. The control system of claim 7 wherein said gear ratio is 5:1.

9. The control system of claim 8 wherein said rotor includes a circular disk mounted on said rotary shaft and including electromagnetic means extending along opposed quarter segments thereof, and said pair of arms include magnetic means cooperatively associated with said electromagnetic means for selectively positioning the position of said arms.

10. The control system of claim 9 wherein said arms are constructed of high density tungsten.

11. The control system of claim 10 including control means responsive to a control signal for positioning the arms of said rotor to selective positions in response to said signal, and said control means includes means for sensing the angular position of said servo motor and altering said signal in response thereto.

12. An airframe control system comprising:

a variable pitch control surface, a servo control motor operatively connected to said variable pitch control surface for selectively positioning said control surface in response to a control signal, and a variable inertia rotor drivingly connected to said servo motor including a rotary shaft and variably positionable inertial mass mounted on said rotor and positioned for selective positioning of said mass relative to said rotary shaft for varying the inertia of said rotor in response to said signal.

13. An airframe control system of claim 12 wherein:

said inertia rotor includes a circular disk mounted on said rotary shaft and a pair of arms rotatably mounted on a shaft coaxial of said disk and movable in response to said signal from positions parallel to said rotary shaft and at positions up to 90° relative thereto.

14. The control system of claim 13 wherein:

said disk includes a quarter segment of electromagnetic windings on each side thereof, and each of said arms includes a magnet disposed adjacent to the respective electromagnetic windings and responsive thereto for angular positioning of said arms relative to said axis.

15. The control system of claim 14 wherein:

said inertial rotor is drivingly connected to said servo motor by means of gear train having a stepped up gear ratio.

16. The control system of claim 15 including means responsive to a control signal for said servo motor for controlling the angular positioning of said arms.

17. A control system for a rolling airframe, said system comprising:

a variable pitch control surface, a servo control motor operatively connected to said variable pitch control surface for selectively positioning said control surface in response to a control signal, a variable inertia rotor drivingly connected to said servo motor including a rotary shaft and variably positionable inertial mass mounted on said rotor and positioned for selective positioning of said mass relative to said rotary shaft for varying the inertia of said rotor in response to said signal, a circular disk mounted on said rotary shaft and a pair of arms rotatably mounted on a shaft coaxial of said disk for defining said inertial mass and movable in response to said signal from positions parallel to said rotary shaft and at a positions up to 90° relative thereto, a quarter segment of electromagnetic windings mounted on each side of said disk, and a magnet on each of said arms disposed adjacent to the respective electromagnetic windings and responsive thereto for angular positioning of said arms relative to said axis.

18. The control system of claim 17 further comprising control means responsive to a steering signal of said airframe for controlling the positioning of said arms in response thereto.

* * * * *